US008096633B2

(12) United States Patent
Takahashi

(10) Patent No.: US 8,096,633 B2
(45) Date of Patent: Jan. 17, 2012

(54) LIQUID DROPLET EJECTING APPARATUS

(75) Inventor: Yoshikazu Takahashi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 469 days.

(21) Appl. No.: 12/415,224

(22) Filed: Mar. 31, 2009

(65) Prior Publication Data

US 2009/0244139 A1 Oct. 1, 2009

(30) Foreign Application Priority Data

Mar. 31, 2008 (JP) ..... 2008-089388

(51) Int. Cl.
*B41J 29/38* (2006.01)

(52) U.S. Cl. ..... 347/14; 347/9; 347/12; 347/15

(58) Field of Classification Search ..... 347/9, 12, 347/14, 15

See application file for complete search history.

(56) References Cited

U.S. PATENT DOCUMENTS

| | | | |
|---|---|---|---|
| 6,257,686 | B1 | 7/2001 | Takahashi et al. |
| 6,386,665 | B2 | 5/2002 | Takahashi et al. |
| 6,412,896 | B2 | 7/2002 | Takahashi et al. |
| 6,416,149 | B2 | 7/2002 | Takahashi |
| 2002/0140748 | A1 | 10/2002 | Kanaya et al. |
| 2005/0190221 | A1 | 9/2005 | Iriguchi |

FOREIGN PATENT DOCUMENTS

| | | |
|---|---|---|
| JP | 2000-218817 | 8/2000 |
| JP | 2000-218823 | 8/2000 |
| JP | 2001-301206 A | 10/2001 |
| JP | 2005-238728 | 9/2005 |

*Primary Examiner* — Julian Huffman

(74) *Attorney, Agent, or Firm* — Frommer Lawrence & Haug LLP

(57) ABSTRACT

An object of the invention is to provide a liquid droplet ejecting apparatus capable of determining a type of droplet to be ejected through each nozzle at an arbitrary ejection timing, with consideration of not only an influence of droplet ejections at preceding and following ejection timings, but also crosstalk between a nozzle column and another nozzle column.

A data generation circuit of the liquid droplet ejecting apparatus includes a first storage unit, a second storage unit, and a droplet type determination unit. The first storage unit stores therein information on a plurality of types of droplets. The second storage unit stores therein time-sequence information of a type of droplet which information associates each ejection timing of each nozzle with one of the types of droplets. The droplet type determination unit determines a type of droplet to be associated with an arbitrary ejection timing of each nozzle, with reference to an ejection plan of the nozzle included in the time-sequence information, and a type of droplet associated with the arbitrary ejection timing of another nozzle.

10 Claims, 16 Drawing Sheets

FIG. 8

| TYPE OF DROPLET | DROPLET VOLUME (PL) |
|---|---|
| NO EJECTION | 0 |
| SMALL DROPLET S | 1.5 |
| MEDIUM DROPLET M | 3 |
| LARGE DROPLET L | 10 |

FIG. 9

| EJECTION TIMING | tm1 | tm2 | ... | tm(n−2) | tm(n−1) | tm(n) | tm(n+1) | tm(n+2) | ... |
|---|---|---|---|---|---|---|---|---|---|
| TYPE OF DROPLET | L | M | | NO EJECTION | S | M | L | L | |

FIG. 10

| EJECTION TIMING | tm(n−1) | tm(n) | tm(n+1) |
|---|---|---|---|
| TYPE OF DROPLET | NO EJECTION | S | EJECTION |
| | NO EJECTION | S | NO EJECTION |
| | S | S | EJECTION |
| | S | S | NO EJECTION |
| | M | S | EJECTION |
| | M | S | NO EJECTION |
| | L | S→M | EJECTION |
| | L | S→M | NO EJECTION |
| | NO EJECTION | M | EJECTION |
| | NO EJECTION | M | NO EJECTION |
| | S | M | EJECTION |
| | S | M | NO EJECTION |
| | M | M | EJECTION |
| | M | M | NO EJECTION |
| | L | M | EJECTION |
| | L | M | NO EJECTION |
| | NO EJECTION | L1 | EJECTION |
| | NO EJECTION | L2 | NO EJECTION |
| | S | L1 | EJECTION |
| | S | L2 | NO EJECTION |
| | M | L1 | EJECTION |
| | M | L2 | NO EJECTION |
| | L | L1 | EJECTION |
| | L | L2 | NO EJECTION |

FIG. 11

50 % OR MORE TARGET COLUMN DUTY

| ANOTHER COLUMN DUTY | 50 % OR MORE | | | LESS THAN 50 % | | |
|---|---|---|---|---|---|---|
| EJECTION TIMING | tm(n−1) | tm(n) | tm(n+1) | tm(n−1) | tm(n) | tm(n+1) |
| TYPE OF DROPLET | NO EJECTION | S→M | EJECTION | NO EJECTION | S | EJECTION |
| | NO EJECTION | S→M | NO EJECTION | NO EJECTION | S | NO EJECTION |
| | S | S→M | EJECTION | S | S | EJECTION |
| | S | S→M | NO EJECTION | S | S | NO EJECTION |
| | M | S→M | EJECTION | M | S | EJECTION |
| | M | S→M | NO EJECTION | M | S | NO EJECTION |
| | L | S→M | EJECTION | L | S→M | EJECTION |
| | L | S→M | NO EJECTION | L | S→M | NO EJECTION |
| | NO EJECTION | M | EJECTION | NO EJECTION | M | EJECTION |
| | NO EJECTION | M | NO EJECTION | NO EJECTION | M | NO EJECTION |
| | S | M | EJECTION | S | M | EJECTION |
| | S | M | NO EJECTION | S | M | NO EJECTION |
| | M | M | EJECTION | M | M | EJECTION |
| | M | M | NO EJECTION | M | M | NO EJECTION |
| | L | M | EJECTION | L | M | EJECTION |
| | L | M | NO EJECTION | L | M | NO EJECTION |
| | NO EJECTION | L→M | EJECTION | NO EJECTION | L→M | EJECTION |
| | NO EJECTION | L→M | NO EJECTION | NO EJECTION | L→M | NO EJECTION |
| | S | L→M | EJECTION | S | L→M | EJECTION |
| | S | L→M | NO EJECTION | S | L→M | NO EJECTION |
| | M | L→M | EJECTION | M | L→M | EJECTION |
| | M | L→M | NO EJECTION | M | L→M | NO EJECTION |
| | L | L→M | EJECTION | L | L→M | EJECTION |
| | L | L→M | NO EJECTION | L | L→M | NO EJECTION |

(a) (b)

FIG. 12

LESS THAN 50 % TARGET COLUMN DUTY

| ANOTHER COLUMN DUTY | 50 % OR MORE | | |
|---|---|---|---|
| EJECTION TIMING | tm(n−1) | tm(n) | tm(n+1) |
| TYPE OF DROPLET | NO EJECTION | S→M | EJECTION |
| | NO EJECTION | S→M | NO EJECTION |
| | S | S→M | EJECTION |
| | S | S→M | NO EJECTION |
| | M | S→M | EJECTION |
| | M | S→M | NO EJECTION |
| | L | S→M | EJECTION |
| | L | S→M | NO EJECTION |
| | NO EJECTION | M | EJECTION |
| | NO EJECTION | M | NO EJECTION |
| | S | M | EJECTION |
| | S | M | NO EJECTION |
| | M | M | EJECTION |
| | M | M | NO EJECTION |
| | L | M | EJECTION |
| | L | M | NO EJECTION |
| | NO EJECTION | L→L1 | EJECTION |
| | NO EJECTION | L→L2 | NO EJECTION |
| | S | L→L1 | EJECTION |
| | S | L→L2 | NO EJECTION |
| | M | L→L1 | EJECTION |
| | M | L→L2 | NO EJECTION |
| | L | L→L1 | EJECTION |
| | L | L→L2 | NO EJECTION |

(a)

| LESS THAN 50 % | | |
|---|---|---|
| tm(n−1) | tm(n) | tm(n+1) |
| NO EJECTION | S | EJECTION |
| NO EJECTION | S | NO EJECTION |
| S | S | EJECTION |
| S | S | NO EJECTION |
| M | S | EJECTION |
| M | S | NO EJECTION |
| L | S | EJECTION |
| L | S | NO EJECTION |
| NO EJECTION | M | EJECTION |
| NO EJECTION | M | NO EJECTION |
| S | M | EJECTION |
| S | M | NO EJECTION |
| M | M | EJECTION |
| M | M | NO EJECTION |
| L | M | EJECTION |
| L | M | NO EJECTION |
| NO EJECTION | L→L1 | EJECTION |
| NO EJECTION | L→L2 | NO EJECTION |
| S | L→L1 | EJECTION |
| S | L→L2 | NO EJECTION |
| M | L→L1 | EJECTION |
| M | L→L2 | NO EJECTION |
| L | L→L1 | EJECTION |
| L | L→L2 | NO EJECTION |

(b)

FIG. 13

80 % OR MORE TARGET COLUMN DUTY

| ANOTHER COLUMN DUTY | 80 % OR MORE | | | 50 % OR MORE BUT LESS THAN 80 % | | | 20 % OR MORE BUT LESS THAN 50 % | | | LESS THAN 20 % | | |
|---|---|---|---|---|---|---|---|---|---|---|---|---|
| EJECTION TIMING | tm(n−1) | tm(n) | tm(n+1) | tm(n−1) | tm(n) | tm(n+1) | tm(n−1) | tm(n) | tm(n+1) | tm(n−1) | tm(n) | tm(n+1) |
| TYPE OF DROPLET | NO EJECTION | S→M | EJECTION | NO EJECTION | S | EJECTION | NO EJECTION | S | EJECTION | NO EJECTION | S | EJECTION |
| | NO EJECTION | S→M | NO EJECTION | NO EJECTION | S | NO EJECTION | NO EJECTION | S | NO EJECTION | NO EJECTION | S | NO EJECTION |
| | S | S→M | EJECTION | S | S | EJECTION | S | S | EJECTION | S | S | EJECTION |
| | S | S→M | NO EJECTION | S | S | NO EJECTION | S | S | NO EJECTION | S | S | NO EJECTION |
| | M | S→M | EJECTION | M | S→M | EJECTION | M | S | EJECTION | M | S | EJECTION |
| | M | S→M | NO EJECTION | M | S→M | NO EJECTION | M | S | NO EJECTION | M | S | NO EJECTION |
| | L | S→M | EJECTION | L | S→M | EJECTION | L | S→M | EJECTION | L | S→M | EJECTION |
| | L | S→M | NO EJECTION | L | S→M | NO EJECTION | L | S→M | NO EJECTION | L | S→M | NO EJECTION |
| | NO EJECTION | M | EJECTION | NO EJECTION | M | EJECTION | NO EJECTION | M | EJECTION | NO EJECTION | M | EJECTION |
| | NO EJECTION | M | NO EJECTION | NO EJECTION | M | NO EJECTION | NO EJECTION | M | NO EJECTION | NO EJECTION | M | NO EJECTION |
| | S | M | EJECTION | S | M | EJECTION | S | M | EJECTION | S | M | EJECTION |
| | S | M | NO EJECTION | S | M | NO EJECTION | S | M | NO EJECTION | S | M | NO EJECTION |
| | M | M | EJECTION | M | M | EJECTION | M | M | EJECTION | M | M | EJECTION |
| | M | M | NO EJECTION | M | M | NO EJECTION | M | M | NO EJECTION | M | M | NO EJECTION |
| | L | M | EJECTION | L | M | EJECTION | L | M | EJECTION | L | M | EJECTION |
| | L | M | NO EJECTION | L | M | NO EJECTION | L | M | NO EJECTION | L | M | NO EJECTION |
| | NO EJECTION | L→M | EJECTION | NO EJECTION | L→M | EJECTION | NO EJECTION | L→M | EJECTION | NO EJECTION | L→M | EJECTION |
| | NO EJECTION | L→M | NO EJECTION | NO EJECTION | L→M | NO EJECTION | NO EJECTION | L→M | NO EJECTION | NO EJECTION | L→M | NO EJECTION |
| | S | L→M | EJECTION | S | L→M | EJECTION | S | L→M | EJECTION | S | L→M | EJECTION |
| | S | L→M | NO EJECTION | S | L→M | NO EJECTION | S | L→M | NO EJECTION | S | L→M | NO EJECTION |
| | M | L→M | EJECTION | M | L→M | EJECTION | M | L→M | EJECTION | M | L→M | EJECTION |
| | M | L→M | NO EJECTION | M | L→M | NO EJECTION | M | L→M | NO EJECTION | M | L→M | NO EJECTION |
| | L | L→M | EJECTION | L | L→M | EJECTION | L | L→M | EJECTION | L | L→M | EJECTION |
| | L | L→M | NO EJECTION | L | L→M | NO EJECTION | L | L→M | NO EJECTION | L | L→M | NO EJECTION |
| | (a) | | | (b) | | | (c) | | | (d) | | |

FIG. 14

50 % OR MORE BUT LESS THAN 80 % TARGET COLUMN DUTY

| ANOTHER COLUMN DUTY | 80 % OR MORE | | | 50 % OR MORE BUT LESS THAN 80 % | | | 20 % OR MORE BUT LESS THAN 50 % | | | LESS THAN 20 % | | |
|---|---|---|---|---|---|---|---|---|---|---|---|---|
| EJECTION TIMING | tm(n−1) | tm(n) | tm(n+1) | tm(n−1) | tm(n) | tm(n+1) | tm(n−1) | tm(n) | tm(n+1) | tm(n−1) | tm(n) | tm(n+1) |
| TYPE OF DROPLET | NO EJECTION | S→M | EJECTION | NO EJECTION | S | EJECTION | NO EJECTION | S | EJECTION | NO EJECTION | S | EJECTION |
| | NO EJECTION | S→M | NO EJECTION | NO EJECTION | S | NO EJECTION | NO EJECTION | S | NO EJECTION | NO EJECTION | S | NO EJECTION |
| | S | S→M | EJECTION | S | S | EJECTION | S | S | EJECTION | S | S | EJECTION |
| | S | S→M | NO EJECTION | S | S | NO EJECTION | S | S | NO EJECTION | S | S | NO EJECTION |
| | M | S→M | EJECTION | M | S→M | EJECTION | M | S | EJECTION | M | S | EJECTION |
| | M | S→M | NO EJECTION | M | S→M | NO EJECTION | M | S | NO EJECTION | M | S | NO EJECTION |
| | L | S→M | EJECTION | L | S→M | EJECTION | L | S→M | EJECTION | L | S | EJECTION |
| | L | S→M | NO EJECTION | L | S→M | NO EJECTION | L | S→M | NO EJECTION | L | S | NO EJECTION |
| | NO EJECTION | M | EJECTION | NO EJECTION | M | EJECTION | NO EJECTION | M | EJECTION | NO EJECTION | M | EJECTION |
| | NO EJECTION | M | NO EJECTION | NO EJECTION | M | NO EJECTION | NO EJECTION | M | NO EJECTION | NO EJECTION | M | NO EJECTION |
| | S | M | EJECTION | S | M | EJECTION | S | M | EJECTION | S | M | EJECTION |
| | S | M | NO EJECTION | S | M | NO EJECTION | S | M | NO EJECTION | S | M | NO EJECTION |
| | M | M | EJECTION | M | M | EJECTION | M | M | EJECTION | M | M | EJECTION |
| | M | M | NO EJECTION | M | M | NO EJECTION | M | M | NO EJECTION | M | M | NO EJECTION |
| | L | M | EJECTION | L | M | EJECTION | L | M | EJECTION | L | M | EJECTION |
| | L | M | NO EJECTION | L | M | NO EJECTION | L | M | NO EJECTION | L | M | NO EJECTION |
| | NO EJECTION | L→L1 | EJECTION | NO EJECTION | L→L1 | EJECTION | NO EJECTION | L→L1 | EJECTION | NO EJECTION | L→L1 | EJECTION |
| | NO EJECTION | L→L2 | NO EJECTION | NO EJECTION | L→L2 | NO EJECTION | NO EJECTION | L→L2 | NO EJECTION | NO EJECTION | L→L2 | NO EJECTION |
| | S | L→L1 | EJECTION | S | L→L1 | EJECTION | S | L→L1 | EJECTION | S | L→L1 | EJECTION |
| | S | L→L2 | NO EJECTION | S | L→L2 | NO EJECTION | S | L→L2 | NO EJECTION | S | L→L2 | NO EJECTION |
| | M | L→M | EJECTION | M | L→M | EJECTION | M | L→M | EJECTION | M | L→M | EJECTION |
| | M | L→M | NO EJECTION | M | L→M | NO EJECTION | M | L→M | NO EJECTION | M | L→M | NO EJECTION |
| | L | L→M | EJECTION | L | L→M | EJECTION | L | L→M | EJECTION | L | L→M | EJECTION |
| | L | L→M | NO EJECTION | L | L→M | NO EJECTION | L | L→M | NO EJECTION | L | L→M | NO EJECTION |
| | (a) | | | (b) | | | (c) | | | (d) | | |

FIG. 15

20 % OR MORE BUT LESS THAN 50 % TARGET COLUMN DUTY

| ANOTHER COLUMN DUTY | 80 % OR MORE | | | 50 % OR MORE BUT LESS THAN 80 % | | | 20 % OR MORE BUT LESS THAN 50 % | | | LESS THAN 20 % | | |
|---|---|---|---|---|---|---|---|---|---|---|---|---|
| EJECTION TIMING | tm(n−1) | tm(n) | tm(n+1) | tm(n−1) | tm(n) | tm(n+1) | tm(n−1) | tm(n) | tm(n+1) | tm(n−1) | tm(n) | tm(n+1) |
| TYPE OF DROPLET | NO EJECTION | S→M | EJECTION | NO EJECTION | S | EJECTION | NO EJECTION | S | EJECTION | NO EJECTION | S | EJECTION |
| | NO EJECTION | S→M | NO EJECTION | NO EJECTION | S | NO EJECTION | NO EJECTION | S | NO EJECTION | NO EJECTION | S | NO EJECTION |
| | S | S→M | EJECTION | S | S | EJECTION | S | S | EJECTION | S | S | EJECTION |
| | S | S→M | NO EJECTION | S | S | NO EJECTION | S | S | NO EJECTION | S | S | NO EJECTION |
| | M | S→M | EJECTION | M | S→M | EJECTION | M | S | EJECTION | M | S | EJECTION |
| | M | S→M | NO EJECTION | M | S→M | NO EJECTION | M | S | NO EJECTION | M | S | NO EJECTION |
| | L | S→M | EJECTION | L | S→M | EJECTION | L | S→M | EJECTION | L | S | EJECTION |
| | L | S→M | NO EJECTION | L | S→M | NO EJECTION | L | S→M | NO EJECTION | L | S | NO EJECTION |
| | NO EJECTION | M | EJECTION | NO EJECTION | M | EJECTION | NO EJECTION | M | EJECTION | NO EJECTION | M | EJECTION |
| | NO EJECTION | M | NO EJECTION | NO EJECTION | M | NO EJECTION | NO EJECTION | M | NO EJECTION | NO EJECTION | M | NO EJECTION |
| | S | M | EJECTION | S | M | EJECTION | S | M | EJECTION | S | M | EJECTION |
| | S | M | NO EJECTION | S | M | NO EJECTION | S | M | NO EJECTION | S | M | NO EJECTION |
| | M | M | EJECTION | M | M | EJECTION | M | M | EJECTION | M | M | EJECTION |
| | M | M | NO EJECTION | M | M | NO EJECTION | M | M | NO EJECTION | M | M | NO EJECTION |
| | L | M | EJECTION | L | M | EJECTION | L | M | EJECTION | L | M | EJECTION |
| | L | M | NO EJECTION | L | M | NO EJECTION | L | M | NO EJECTION | L | M | NO EJECTION |
| | NO EJECTION | L→L1 | EJECTION | NO EJECTION | L→L1 | EJECTION | NO EJECTION | L→L1 | EJECTION | NO EJECTION | L→L1 | EJECTION |
| | NO EJECTION | L→L2 | NO EJECTION | NO EJECTION | L→L2 | NO EJECTION | NO EJECTION | L→L2 | NO EJECTION | NO EJECTION | L→L2 | NO EJECTION |
| | S | L→L1 | EJECTION | S | L→L1 | EJECTION | S | L→L1 | EJECTION | S | L→L1 | EJECTION |
| | S | L→L2 | NO EJECTION | S | L→L2 | NO EJECTION | S | L→L2 | NO EJECTION | S | L→L2 | NO EJECTION |
| | M | L→L1 | EJECTION | M | L→L1 | EJECTION | M | L→L1 | EJECTION | M | L→L1 | EJECTION |
| | M | L→L2 | NO EJECTION | M | L→L2 | NO EJECTION | M | L→L2 | NO EJECTION | M | L→L2 | NO EJECTION |
| | L | L→M | EJECTION | L | L→M | EJECTION | L | L→M | EJECTION | L | L→M | EJECTION |
| | L | L→M | NO EJECTION | L | L→M | NO EJECTION | L | L→M | NO EJECTION | L | L→M | NO EJECTION |
| | (a) | | | (b) | | | (c) | | | (d) | | |

FIG. 16

LESS THAN 20 % TARGET COLUMN DUTY

| ANOTHER COLUMN DUTY | 80 % OR MORE | | | 50 % OR MORE BUT LESS THAN 80 % | | | 20 % OR MORE BUT LESS THAN 50 % | | | LESS THAN 20 % | | |
|---|---|---|---|---|---|---|---|---|---|---|---|---|
| EJECTION TIMING | tm(n−1) | tm(n) | tm(n+1) | tm(n−1) | tm(n) | tm(n+1) | tm(n−1) | tm(n) | tm(n+1) | tm(n−1) | tm(n) | tm(n+1) |
| TYPE OF DROPLET | NO EJECTION | S→M | EJECTION | NO EJECTION | S | EJECTION | NO EJECTION | S | EJECTION | NO EJECTION | S | EJECTION |
| | NO EJECTION | S→M | NO EJECTION | NO EJECTION | S | NO EJECTION | NO EJECTION | S | NO EJECTION | NO EJECTION | S | NO EJECTION |
| | S | S→M | EJECTION | S | S | EJECTION | S | S | EJECTION | S | S | EJECTION |
| | S | S→M | NO EJECTION | S | S | NO EJECTION | S | S | NO EJECTION | S | S | NO EJECTION |
| | M | S→M | EJECTION | M | S→M | EJECTION | M | S | EJECTION | M | S | EJECTION |
| | M | S→M | NO EJECTION | M | S→M | NO EJECTION | M | S | NO EJECTION | M | S | NO EJECTION |
| | L | S→M | EJECTION | L | S→M | EJECTION | L | S→M | EJECTION | L | S | EJECTION |
| | L | S→M | NO EJECTION | L | S→M | NO EJECTION | L | S→M | NO EJECTION | L | S | NO EJECTION |
| | NO EJECTION | M | EJECTION | NO EJECTION | M | EJECTION | NO EJECTION | M | EJECTION | NO EJECTION | M | EJECTION |
| | NO EJECTION | M | NO EJECTION | NO EJECTION | M | NO EJECTION | NO EJECTION | M | NO EJECTION | NO EJECTION | M | NO EJECTION |
| | S | M | EJECTION | S | M | EJECTION | S | M | EJECTION | S | M | EJECTION |
| | S | M | NO EJECTION | S | M | NO EJECTION | S | M | NO EJECTION | S | M | NO EJECTION |
| | M | M | EJECTION | M | M | EJECTION | M | M | EJECTION | M | M | EJECTION |
| | M | M | NO EJECTION | M | M | NO EJECTION | M | M | NO EJECTION | M | M | NO EJECTION |
| | L | M | EJECTION | L | M | EJECTION | L | M | EJECTION | L | M | EJECTION |
| | L | M | NO EJECTION | L | M | NO EJECTION | L | M | NO EJECTION | L | M | NO EJECTION |
| | NO EJECTION | L→L1 | EJECTION | NO EJECTION | L→L1 | EJECTION | NO EJECTION | L→L1 | EJECTION | NO EJECTION | L→L1 | EJECTION |
| | NO EJECTION | L→L2 | NO EJECTION | NO EJECTION | L→L2 | NO EJECTION | NO EJECTION | L→L2 | NO EJECTION | NO EJECTION | L→L2 | NO EJECTION |
| | S | L→L1 | EJECTION | S | L→L1 | EJECTION | S | L→L1 | EJECTION | S | L→L1 | EJECTION |
| | S | L→L2 | NO EJECTION | S | L→L2 | NO EJECTION | S | L→L2 | NO EJECTION | S | L→L2 | NO EJECTION |
| | M | L→L1 | EJECTION | M | L→L1 | EJECTION | M | L→L1 | EJECTION | M | L→L1 | EJECTION |
| | M | L→L2 | NO EJECTION | M | L→L2 | NO EJECTION | M | L→L2 | NO EJECTION | M | L→L2 | NO EJECTION |
| | L | L→L1 | EJECTION | L | L→L1 | EJECTION | L | L→L1 | EJECTION | L | L→L1 | EJECTION |
| | L | L→L2 | NO EJECTION | L | L→L2 | NO EJECTION | L | L→L2 | NO EJECTION | L | L→L2 | NO EJECTION |
| | (a) | | | (b) | | | (c) | | | (d) | | |

LIQUID DROPLET EJECTING APPARATUS

CROSS REFERENCE TO RELATED APPLICATION

The present application claims priority from Japanese Patent Application No. 2008-089388, which was filed on Mar. 31, 2008 the disclosure of which is herein incorporated by reference in its entirety.

BACKGROUND OF THE INVENTION

1. Field of the Invention

The present invention relates to a liquid droplet ejecting apparatus which ejects a droplet.

2. Description of the Related Art

As liquid droplet ejecting apparatuses which eject droplets through nozzles, inkjet printers which eject ink droplets towards a recording medium to form a desired image has been traditionally known. Such an inkjet printer is usually capable of selectively ejecting, through nozzles which form dots, a plurality of types of droplets each having a different size or volume based on gradation information of each pixel forming an image to create gradations of color.

Such inkjet printers have a problem that an actual volume of a droplet differs from a predetermined volume when the droplet is ejected after a droplet is ejected at a certain timing. This happens because the droplet to be ejected is susceptible to a pressure wave, machine vibration, or the like left from the preceding ejection. Thus, Tokukai 2001-301206 (Japanese Unexamined Patent Publication), for example, discloses an inkjet printer (ink droplet ejecting apparatus) having a plurality of drive waveforms to be supplied to an actuator for ejecting droplets through nozzles. The inkjet printer (ink droplet ejecting apparatus) is configured to select a drive waveform of an ejection timing out of the plurality of drive waveforms with consideration of the types of droplets respectively associated with the ejection timing and the preceding and following ejection timings; i.e., ejection plan.

A droplet to be ejected through each nozzle, however, is susceptible to not only the ejection of droplets through the nozzle at the preceding and the following ejection timings, but also ejection of a droplet through adjacent another nozzle. That is, when droplets are to be simultaneously ejected through the nozzle and the adjacent another nozzle, energy is transmitted between the nozzles or between adjacent ink passages respectively communicating with the nozzles, the energy such as pressure wave or mechanical vibration being generated when each of the droplets is ejected. This reciprocal influence is referred to as crosstalk. This crosstalk may cause an actual volume of a droplet ejected through a nozzle to differ from a predetermined droplet volume.

When determining a type of droplet to be ejected through a nozzle at an ejection timing, the inkjet printer of Tokukai 2001-301206 only refers to types of droplets ejected through the nozzle at the preceding and following ejection timings, leaving out of consideration crosstalk between the nozzle and another nozzle.

SUMMARY OF THE INVENTION

An object of the present invention is to provide a liquid droplet ejecting apparatus capable of determining a type of droplet to be ejected through each nozzle at an arbitrary ejection timing with consideration of not only influences of droplet ejection at the preceding and following ejection timings, but also crosstalk between nozzles.

A liquid droplet ejecting apparatus of the present invention is a liquid droplet ejecting apparatus capable of selectively ejecting, through each of a plurality of nozzles, a type of droplet among a plurality of types of droplets each having a different droplet volume. The liquid droplet ejecting apparatus includes a first storage unit, a second storage unit, and a droplet type determination unit. The first storage unit stores therein information on a plurality of types of droplets. The second storage unit stores therein time-sequence information of a type of droplet which information associates each ejection timing of each nozzle with one of the types of droplets. The droplet type determination unit determines a type of droplet associated with an arbitrary ejection timing of each nozzle, with reference to an ejection plan of the nozzle included in the time-sequence information, and a type of droplet associated with the arbitrary ejection timing of another nozzle.

According to the present invention, the liquid droplet ejecting apparatus determines a type of droplet to be ejected through each nozzle at an arbitrary ejection timing, with consideration of not only an ejection plan of the nozzle, but also a type of droplet to be simultaneously ejected through another nozzle. The ejection plan of the nozzle includes types of droplets to be ejected at the ejection timing as well as at the preceding and following ejection timings. In other words, the liquid droplet ejecting apparatus is capable of determining a type of droplet to be ejected through each nozzle with consideration of crosstalk between the nozzle and another nozzle, which nozzles simultaneously eject droplets.

BRIEF DESCRIPTION OF THE DRAWINGS

Other and further objects, features and advantages of the invention will appear more fully from the following description taken in connection with the accompanying drawings in which:

FIG. 8 illustrates four types of droplets stored in a first storage circuit.

FIG. 9 illustrates time-sequence information of a type of droplet associated with a nozzle.

FIG. 10 is a table used for a drive waveform determination process when determining a drive waveform associated with an ejection timing tm(n) only with consideration of an ejection plan of a nozzle.

FIG. 11 is a table used for a drive waveform determination process, which table associates an ejection plan, an target column duty, and an another column duty, illustrating a case where the target column duty is 50% or more.

FIG. 12 is a table used for a drive waveform determination process, which table associates an ejection plan, an target column duty, and an another column duty, illustrating a case where the target column duty is less than 50%.

FIG. 13 is a table used for a drive waveform determination process according to a modified embodiment, which table associates an ejection plan, an target column duty, and an another column duty, illustrating a case where the target column duty is 80% or more.

FIG. 14 is a table used for a drive waveform determination process according to a modified embodiment, which table associates an ejection plan, an target column duty, and an another column duty, illustrating a case where the target column duty is 50% or more but less than 80%.

FIG. 15 is a table used for a drive waveform determination process according to a modified embodiment, which table associates an ejection plan, an target column duty, and an another column duty, illustrating a case where the target column duty is 20% or more but less than 50%.

FIG. 16 is a table used for a drive waveform determination process according to a modified embodiment, which table associates an ejection plan, an target column duty, and an another column duty, illustrating a case where the target column duty is less than 20%.

DESCRIPTION OF THE PREFERRED EMBODIMENTS

The following describes an embodiment of the present invention. The present embodiment illustrates an example where the present invention is applied to an inkjet printer including an inkjet head which ejects an ink droplet onto a recording sheet.

Figure 1:
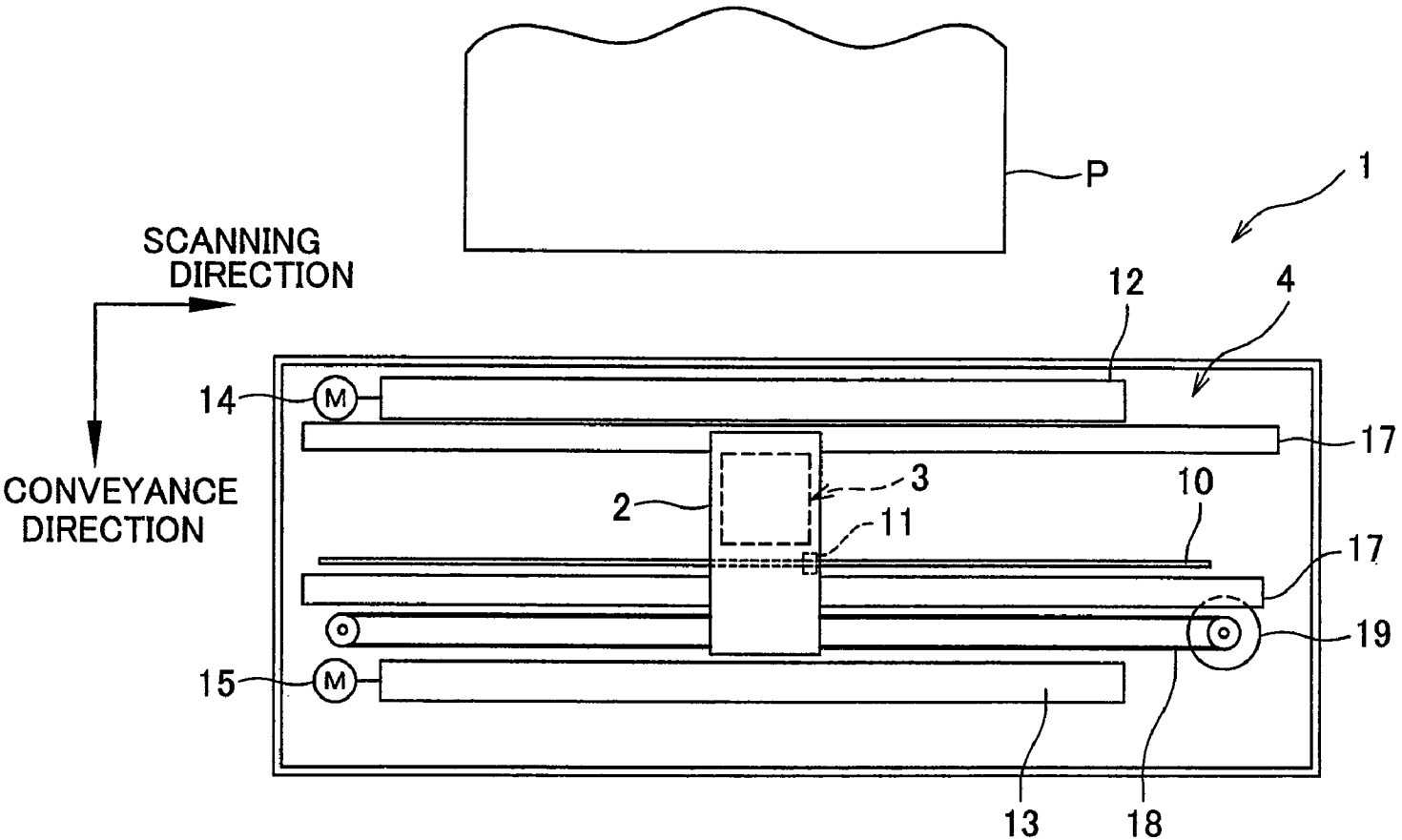
FIG. 1 is a schematic plan view of a printer of the present invention.

A schematic configuration of an inkjet printer 1 (liquid droplet ejecting apparatus) of the present embodiment is described first. FIG. 1 is a schematic plan view of the inkjet printer of the present embodiment. As illustrated in FIG. 1, the printer 1 includes a carriage 2, an inkjet head 3 mounted to the carriage 2, and a conveyor mechanism 4. The carriage 2 is capable of moving back and forth in a predetermined scanning direction; i.e., left-right direction in FIG. 1. The conveyor mechanism 4 conveys a recording sheet P in a conveyance direction perpendicular to the scanning direction.

The carriage 2 is capable of moving back and forth along two guide shafts 17 extending parallel to each other in the scanning direction; i.e., left-right direction in FIG. 1. The carriage 2 is connected to an endless belt 18. Thus, the carriage 2 moves in the scanning direction as the endless belt 18 is run by a carriage drive motor 19. Note that the printer 1 is provided with a linear encoder 10 having a plurality of translucent units (slits) aligned thereon spaced at intervals in the scanning direction. Meanwhile, the carriage 2 is provided with a through-beam photosensor 11 having a light-emitting element and a light-receiving element. The through-beam photosensor 11 counts the number of translucent units of the linear encoder 10 while the carriage 2 is moving, thus allowing the printer 1 to recognize the present position of the carriage 2 in the scanning direction.

The inkjet head 3 is mounted to the carriage 2. The inkjet head 3 has a plurality of nozzles 30 (see FIG. 2) formed on the surface thereof, the surface being opposite to the surface of the inkjet head 3 visible in FIG. 1. The inkjet head 3 ejects ink through the plurality of nozzles 30 towards a recording sheet P conveyed downward in FIG. 1; i.e., conveyance direction by the conveyor mechanism 4, the ink being supplied by a not-illustrated ink cartridge.

The conveyor mechanism 4 includes: a sheet feed roller 12 provided upstream of the inkjet head 3 in the conveyance direction; and a sheet discharge roller 13 provided downstream of the inkjet head 3 in the conveyance direction. The sheet feed roller 12 and the sheet discharge roller 13 are respectively rotated by a sheet feed motor 14 and a sheet discharge motor 15. The conveyor mechanism 4 conveys a recording sheet P with the sheet feed roller 12 from an upper part of FIG. 1 to the inkjet head 3. The conveyor mechanism 4 discharges the recording sheet P with an image or a character recorded thereon by the inkjet head 3, to an lower part of FIG. 1 with the discharge roller 13.

Figure 2:
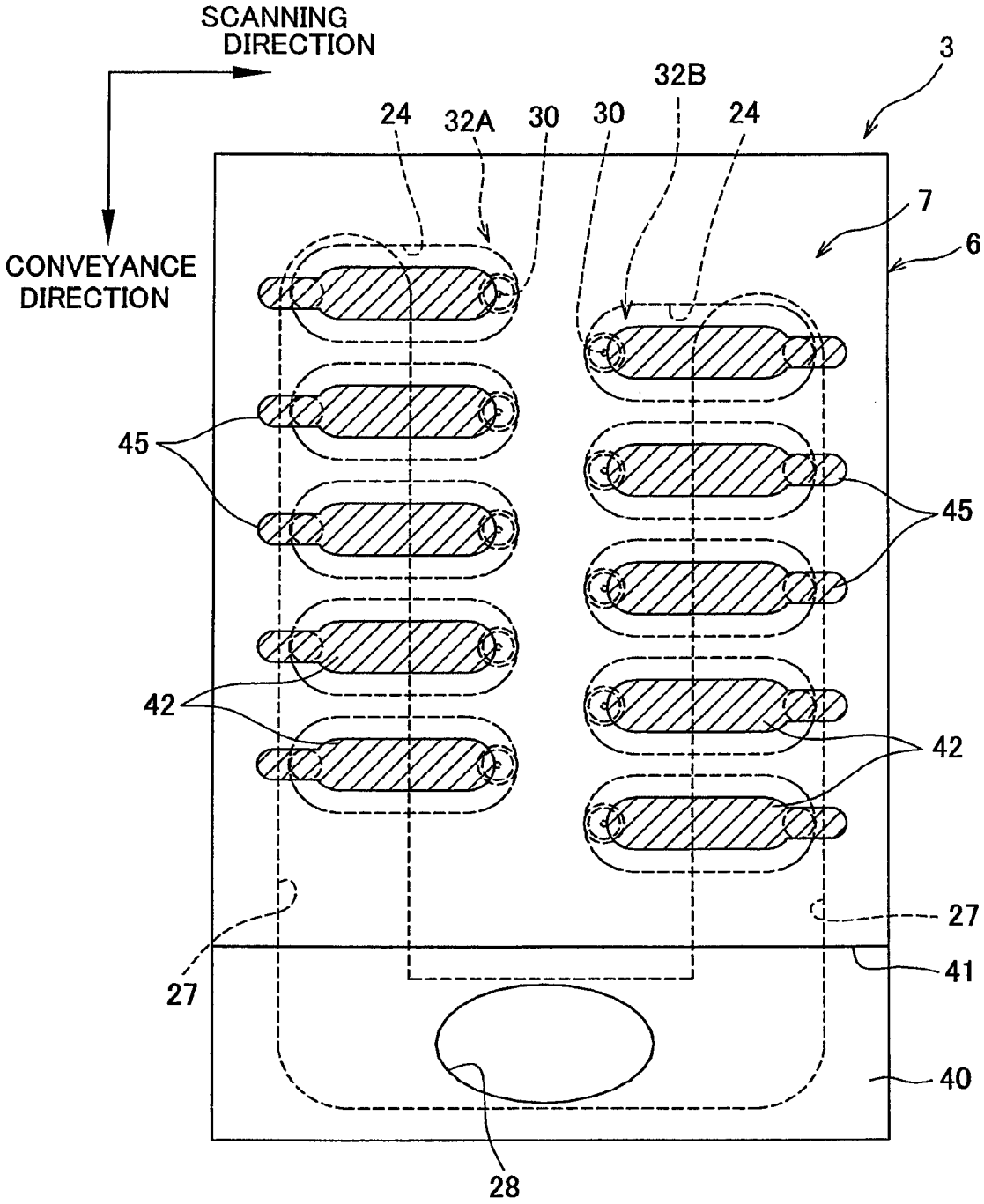
FIG. 2 is a plan view of an inkjet head.
Figure 3:
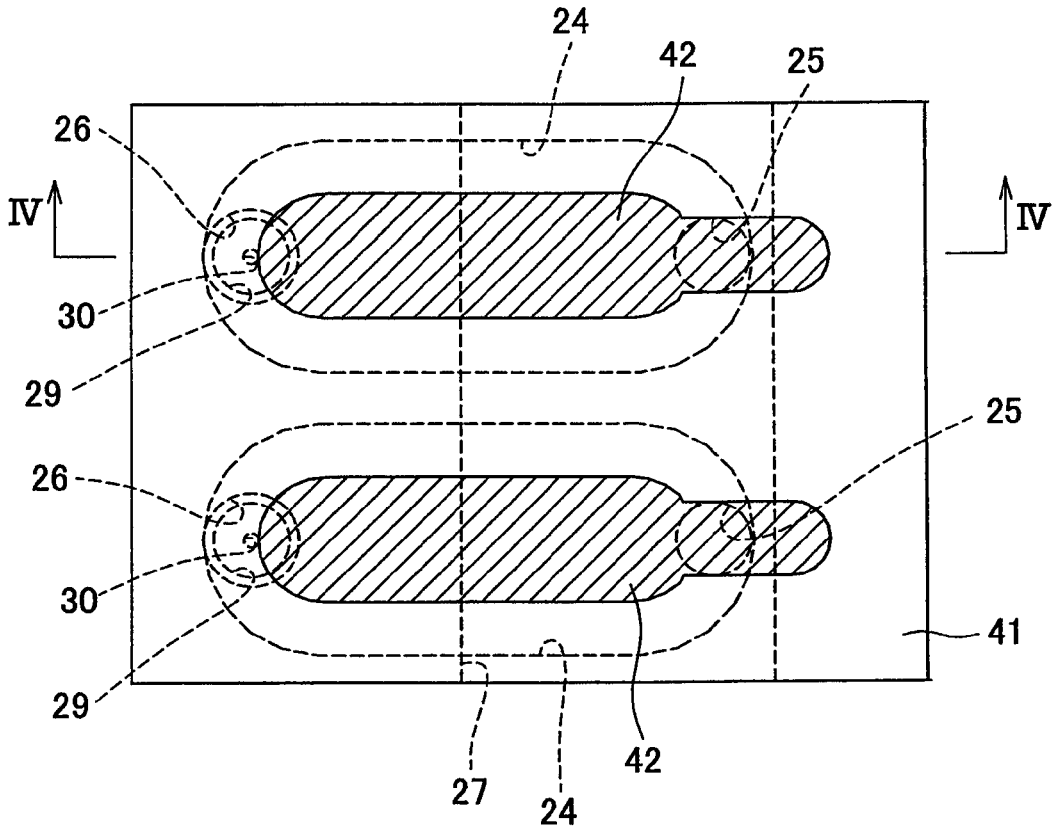
FIG. 3 is a partial magnified view of FIG. 2.
Figure 4:
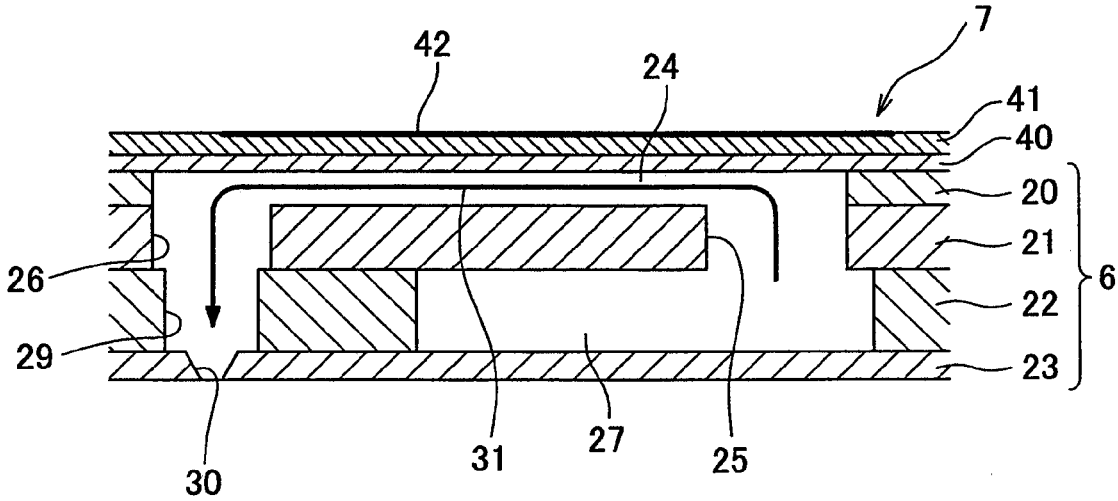
FIG. 4 is a cross-sectional view taken along the IV-IV line of FIG. 3.

Next, the following describes the inkjet head 3. FIG. 2 is a plan view of the inkjet head. FIG. 3 is a partial magnified view of FIG. 2. FIG. 4 is a cross-sectional view taken along the IV-IV line of FIG. 3. As illustrated in FIGS. 2 to 4, the inkjet head 3 has a passage unit 6 with an ink passage formed therein, and a piezoelectric actuator unit 7. The ink passage formed in the passage unit 6 includes the nozzles 30 and pressure chambers 24. The piezoelectric actuator unit 7 applies a pressure to ink inside the pressure chambers 24.

First, the following describes the passage unit 6. As illustrated in FIG. 4, the passage unit 6 includes a cavity plate 20, a base plate 21, a manifold plate 22, and a nozzle plate 23. These plates 20 to 23 are jointed and laminated. Each of the cavity plate 20, the base plate 21, and the manifold plate 22 among the plates 20 to 23 is a substantially rectangular plate in plan view made of a metallic material such as stainless steel. Thus, the ink passage such as a later-described manifold 27 and a pressure chamber 24 is easily etched on the plates 20 to 22. Further, the nozzle plate 23 is made of a high-molecular synthetic resin material such as polyimide, and is jointed to a lower surface of the manifold plate 22 by an adhesive. Alternatively, the nozzle plate 23 may be made of a metallic material such as stainless steel as the other plates 20 to 22.

The cavity plate 20, which is the uppermost plate among the plates 20 to 23, has a plurality of pressure chambers 24 aligned thereon in the plane. Each of the pressure chambers 24 is formed by a hole penetrating the cavity plate 20. Further, the pressure chambers 24 are aligned in two rows in staggered fashion in the conveyance direction; i.e., up-down direction in FIG. 2. Further, each of the pressure chambers 24 is sandwiched by a later-described diaphragm 40 from above and the base plate 21 from below. Further, each of the pressure chambers 24 is a substantial oval long in the scanning direction (left-right direction in FIG. 2) in plan view.

The base plate 21 has communicating holes 25 and 26 formed thereon, as illustrated in FIGS. 3 and 4. Each of the communicating holes 25 overlaps an end portion of a pressure chamber 24 in the longitudinal direction of the pressure chamber 24 in plan view. Each of the communicating holes 26 overlaps the other end portion of the pressure chamber 24 in the longitudinal direction of the pressure chamber 24 in plan view. The manifold plate 22 has two manifolds (common liquid chambers) 27 formed thereon. Each of the manifolds 27 extends in the conveyance direction directly below communicating holes 25 connected to a row of pressure chambers 24. The two manifolds 27 communicate with an ink supply opening 28 formed on the later-described diaphragm 40. Ink is supplied from a not-illustrated ink tank through the ink supply opening 28 to the manifolds 27. Further, the manifold plate 22 has a plurality of communicating holes 29 each communicating with a communicating hole 26. Each of the communicating holes 29 overlaps an end portion of a pressure chamber 24, the end being opposite to the manifold 27 in plan view.

Further, the nozzle plate 23 is provided with a plurality of nozzles 30 each overlapping a communicating hole 29 in plan view. The nozzles 30 are arranged in such a manner that each of the nozzles 30 overlaps an end of a pressure chamber 24, the end being opposite to the connected manifold 27, as illustrated in FIG. 2. In other words, the nozzles 30 each corresponding to a pressure chamber 24 are aligned in the conveyance direction, to constitute nozzle columns 32A and 32B each corresponding to a manifold 27.

Further, as illustrated in FIG. 4, each of the manifolds 27 communicates with pressure chambers 24 through communicating holes 25. Each of the pressure chambers 24 communicates with a nozzle 30 through a communicating hole 26 and a communicating hole 29. Thus, the passage unit 6 has a plurality of individual ink passages 31 formed therein, each individual ink passage 31 forming a path from a manifold 27 through a pressure chamber 24 to a nozzle 30.

Note that in order to simplify the description, FIG. 2 only shows a single passage configuration including the manifolds 27, the pressure chambers 24, the nozzles 30, or the like, communicating with one ink supply opening 28. However, the inkjet head 3 may be a color inkjet head having a plurality of such passage configurations aligned in the scanning direction, each passage configuration being capable of ejecting a different color of ink; e.g., black, yellow, cyan, or magenta.

Next, the following describes the piezoelectric actuator unit 7. As illustrated in FIGS. 2 to 4, the actuator unit 7 includes: a diaphragm 40 provided above the passage unit 6 (cavity plate 20) so as to cover the pressure chambers 24; a piezoelectric layer 41 provided above the diaphragm 40 so as to face the pressure chambers 24; and a plurality of individual electrodes 42 provided above the piezoelectric layer 41.

The diaphragm 40 is a metallic plate having a substantial rectangular shape in plan view. The diaphragm 40 is made of a ferrous alloy such as stainless steel, a copper alloy, a nickel alloy, or a titanium alloy, for example. The diaphragm 40 is provided above the cavity plate 20 to be jointed thereto, so as to cover the plurality of pressure chambers 24. An upper surface of the diaphragm 40 having conductivity is provided below the piezoelectric layer 41 to function as a common electrode which generates an electric field in a thickness direction between the piezoelectric layer 41 and the individual electrodes 42 above the piezoelectric layer 41. The diaphragm 40 serving as the common electrode is connected to a ground circuit of a driver IC 47 (see FIG. 6) which drives the actuator unit 7, and is constantly retained at a ground potential.

The piezoelectric layer 41 is made of a piezoelectric material whose main component is lead zirconate titanate (PZT) which is ferroelectric and a solid solution of lead titanate and lead zirconate. The single piezoelectric layer 41 is provided above the diaphragm 40 over the pressure chambers 24, as illustrated in FIG. 2. Further, the piezoelectric layer 41 is polarized in the thickness direction at least at regions facing the pressure chambers 24.

Provided to regions on the piezoelectric layer 41, the regions facing the pressure chambers 24, are individual electrodes 42. Each of the individual electrodes 42 is a substantial oval in plan slightly smaller than a pressure chamber 24. Each of the individual electrodes 42 faces a center part of the pressure chamber 24. Further, a connecting unit 45 is pulled out of an end of each of the individual electrodes 42 in the longitudinal direction of the individual electrode 42. Each of the connecting units 45 is electrically connected to the driver IC 47 (see FIG. 6) via a not-illustrated Flexible Printed Circuit (FPC). This allows the driver IC 47 to selectively apply one of a predetermined drive potential and the ground potential to the individual electrodes 42.

Next, the following describes a function of the actuator unit 7 when ink is ejected. The driver IC 47 switches the potential to be applied to an individual electrode 42 from the ground potential to the predetermined drive potential, causing a potential difference between the individual electrode 42 and the diaphragm 40 retained at the ground potential. This creates an electric field in the thickness direction in the piezoelectric layer 41 sandwiched by the individual electrode 42 and the diaphragm 40. The direction of the electric field is parallel to the polarized direction of the piezoelectric layer 41. Thus, the regions of the piezoelectric layer 41 facing the individual electrodes 42; i.e., active regions contract in a surface direction perpendicular to the thickness direction. Here, the diaphragm 40 below the piezoelectric layer 41 is fixed to the cavity plate 20. Thus, parts of the diaphragm 40, the parts covering the pressure chambers 24 deform to project towards the pressure chambers 24, as the piezoelectric layer 41 on the diaphragm 40 contracts in the surface direction (unimorph deformation). At this time, ink pressure inside the pressure chambers 24 rises due to a decrease in capacities in the pressure chambers 24. This causes ink to be ejected through the nozzles 30 connected to the pressure chambers 24.

Further, the inkjet head 3 of the present embodiment is capable of selectively ejecting, through each one of the nozzles 30, a plurality of types of droplets of different volumes, in order to enable multitone depiction and thus to perform high-quality image printing.

Specifically, based on data generated in a data generation circuit 60 (see FIG. 6) of a later-described ASIC 54, the driver IC 47 supplies a drive signal corresponding to the data to the actuator unit 7, the data being related to a type of droplet associated with each ejection timing of the nozzle 30. Here, an amount of a droplet; i.e., droplet volume ejected through each of the nozzles 30 is proportional to a pressure applied to the ink inside each of the pressure chambers 24. The driver IC 47 switches the potential of each of the individual electrodes between the drive potential (v0) and the ground potential at appropriate timing by supplying a plurality of types of drive signals each having a different pulse shape to each of the individual electrodes 42 so as to differentiate a pressure applied to the ink in each of the pressure chambers 24. Thus, it is possible to selectively eject droplets of different sizes through the nozzles 30.

Figure 5:
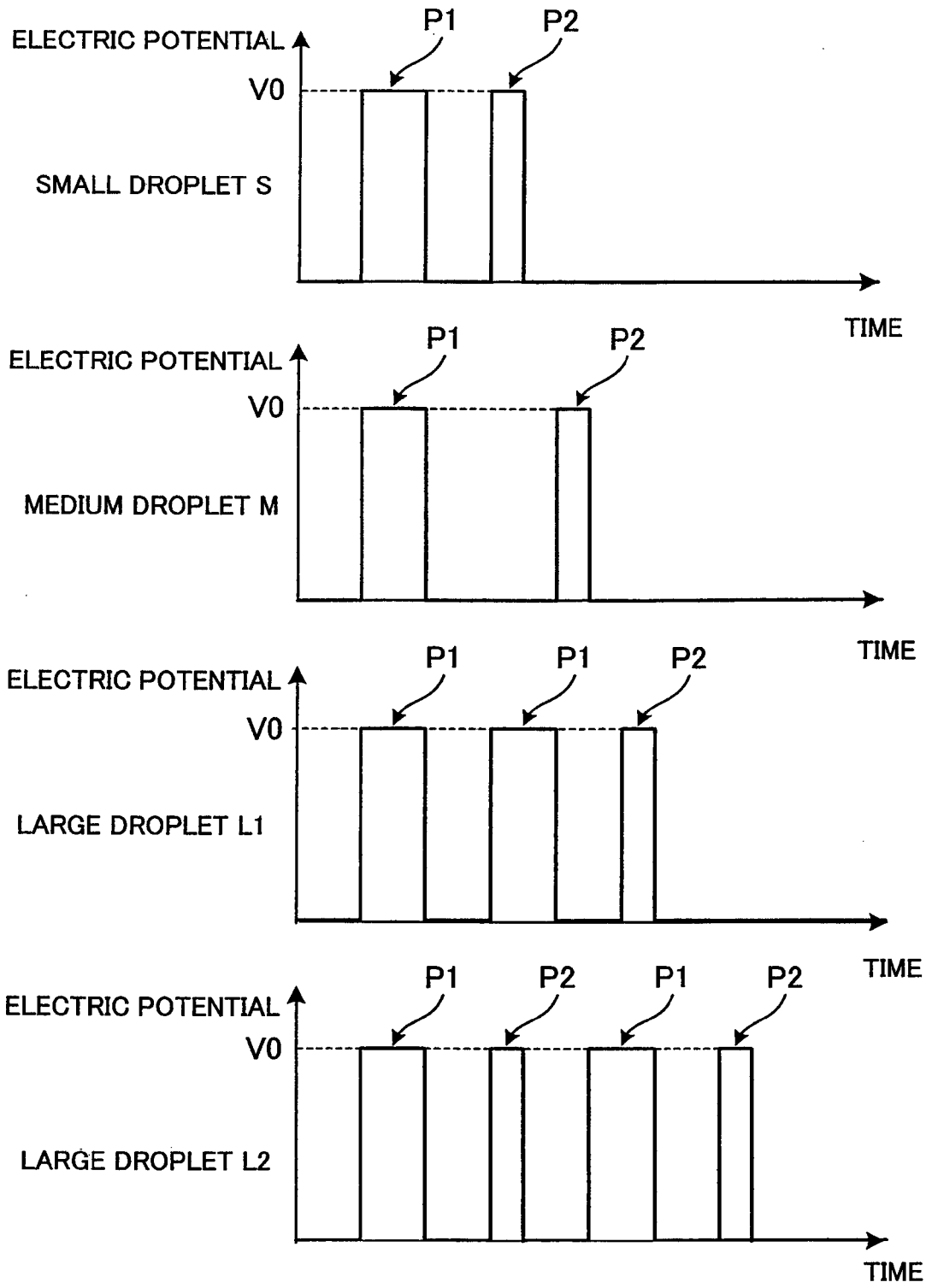
FIG. 5 illustrates pulse shapes of drive signals.

FIG. 5 illustrates pulse shapes of drive signals which the driver IC 47 supplies to the individual electrodes 42 of the actuator unit 7. Hereinafter, a pulse shape is also referred to as a drive waveform. FIG. 5 illustrates four types of drive waveforms: S (small droplet S), M (medium droplet M), L1 (large droplet L), and L2 (large droplet L). The driver IC 47 supplies to the individual electrodes 42 of the actuator unit 7 one of the following five types of drive waveforms: The four types of drive waveforms and a drive waveform which corresponds to no droplet ejection (constant potential).

Each of the drive signals corresponding to the droplet S and the droplet M having a larger droplet volume than the droplet S includes one ejection pulse P1 and one cancel pulse P2, as illustrated in FIG. 5. The ejection pulse P1 is for ejecting a droplet, and the cancel pulse P2 is for restraining a variation in ink pressure caused by the ejection pulse P1. Note that the interval between the ejection pulse P1 and the cancel pulse P2 is smaller in the droplet S than in the droplet M. Thus, when a drive waveform corresponding to the droplet S is impressed to an individual electrode 42, a droplet ejected in response to an ejection pulse P1 is pulled back by a cancel pulse P2 before being disconnected from the nozzle 30, decreasing the size of a droplet ejected through the nozzle 30.

Further, there are two types of drive waveforms; a drive waveform L1 and a drive waveform L2 each corresponding to a droplet L having a larger droplet volume than the droplet S or the droplet M, as illustrated in FIG. 5. The drive waveform L1 is a drive waveform where one cancel pulse P2 is impressed after two consecutive ejection pulses P1. The drive waveform L2 corresponds to a drive waveform longer than the drive waveform L1 (long waveform) where a cancel pulse P2 is imposed between two ejection pulses P1 and after the latter ejection pulse P1. A greater pressure is applied to the ink by impressing two ejection pulses P1, thus allowing a droplet L larger than the droplet S or the droplet M to be ejected.

Impressing the drive waveform L1 on an individual electrode 42 causes ejection of a droplet through a nozzle 30, the droplet having substantially the same size or droplet volume as a droplet ejected through a nozzle 30 when the drive waveform L2 is impressed. However, there are two types of drive waveforms both corresponding to a droplet L for the following reason.

A variation of pressure of remaining ink immediately after a droplet L is ejected is larger than after a droplet S or a droplet M is ejected. This may cause an excess droplet commonly referred to as a satellite droplet to be ejected. When no droplet is to be ejected immediately after a droplet is ejected, a satellite droplet lands in a region where a dot is not supposed to be formed. Thus, a satellite droplet greatly affects print quality. Therefore, a selection is made between a drive waveform L1 and a drive waveform L2 depending on whether or not a droplet is to be ejected immediately after a droplet L is ejected. That is, when a droplet is to be ejected immediately after a droplet L is ejected, consideration of a satellite droplet is less necessary. Thus, the drive waveform L1 is selected, which drive waveform L1 has only one cancel pulse P2 and which is thus relatively less effective for restraining a variation in pressure. On the other hand when no droplet is to be ejected after a droplet L is ejected, the drive waveform L2 is selected in order to surely prevent a satellite droplet, which drive waveform L2 has two cancel pulses P2 and which is thus highly effective for restraining a variation in pressure.

Figure 6:
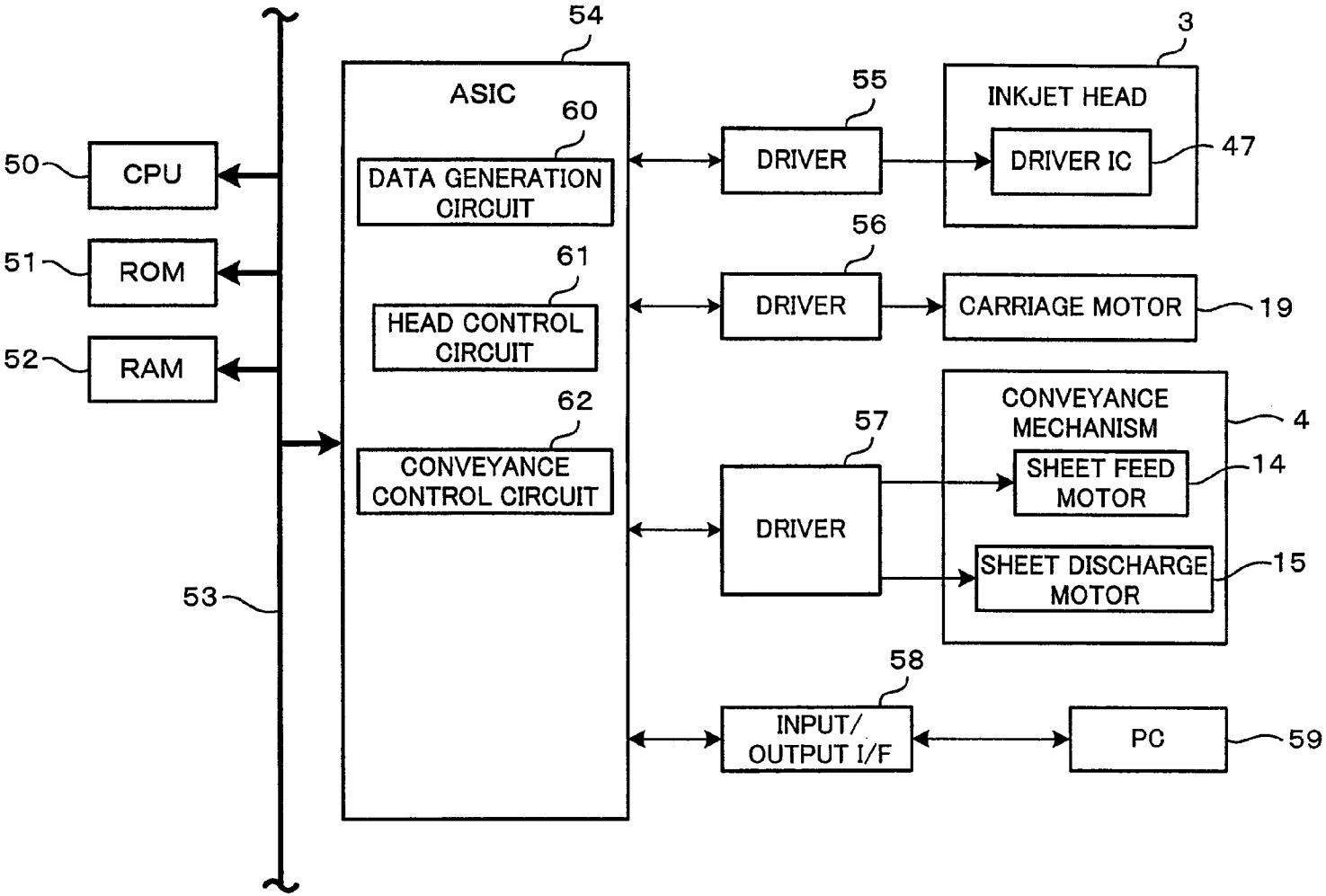
FIG. 6 is a block diagram illustrating a control system of the printer.

Next, the following describes a control system of the printer 1 with reference to the block diagram of FIG. 6. As illustrated in FIG. 6, the control system of the printer 1 of the present embodiment is configured with a microcomputer including a CPU (Central Processing Unit) 50, a ROM (Read Only Memory) 51, a RAM (Random Access Memory) 52, and a bus 53. The bus 53 connects the CPU 50, ROM 51, and RAM 52. The bus 53 is also connected to an ASIC (Application Specific Integrated Circuit) 54 which drive controls: the driver IC 47 of the inkjet head 3; the carriage drive motor 19 which drives the carriage 2; and the sheet feed motor 14, sheet discharge motor 15, or the like of the conveyor mechanism 4, respectively through drivers 55, 56, and 57. Further, the ASIC 54 is connected to a PC (Personal Computer) 59 serving as an external device through an input/output interface (I/F) 58 so as to allow data communication therebetween.

Further, the ASIC 54 is incorporated with a data generation circuit 60, a head control circuit 61, a conveyance control circuit 62, or the like. The data generation circuit 60 generates, based on image data inputted from the PC 59, data necessary for recording an image on a recording sheet P with the inkjet head 3. The head control circuit 61 controls the driver IC 47 of the inkjet head 3 and the carriage drive motor 19, based on the data generated by the data generation circuit 60. The conveyance control circuit 62 controls the sheet feed motor 14 and the sheet discharge motor 15 of the conveyor mechanism 4, based on the data generated by the data generation circuit 60.

Next, the following describes the data generation circuit 60 in detail. In the present embodiment, an image processing is performed in the PC 59 on image data of a desired recording image. Then in the PC 59, types of droplets to be ejected through the nozzles 30 to form dots are selected from the four droplet types: droplet S, droplet M, droplet L, and no ejection, according to the gradation information of each pixel forming the image to be recorded. In other words, focusing on a nozzle 30, time-sequence information of a type of droplet is generated in the PC 59, the time-sequence information associating an ejection timing of a nozzle 30 forming a dot with one of the four types of droplets.

Meanwhile, the data generation circuit 60 determines a type of droplet to be associated with an ejection timing of each of the nozzles 30, or more specifically, a drive waveform corresponding to a type of droplet to be associated with an ejection timing of each of the nozzles 30 (see FIG. 5). The determination is made on the basis of the types of droplets respectively associated with the ejection timing and the preceding and the following ejection timings, based on the time-sequence information transmitted from the PC 59. The types of droplets respectively associated with the ejection timing and the preceding and the following ejection timings are hereinafter also referred to as an ejection plan of a nozzle 30. Further at this time, the data generation circuit 60 considers not only the ejection plan of a target nozzle 30, but also crosstalk between the target nozzle 30 and another nozzle 30.

Figure 7:
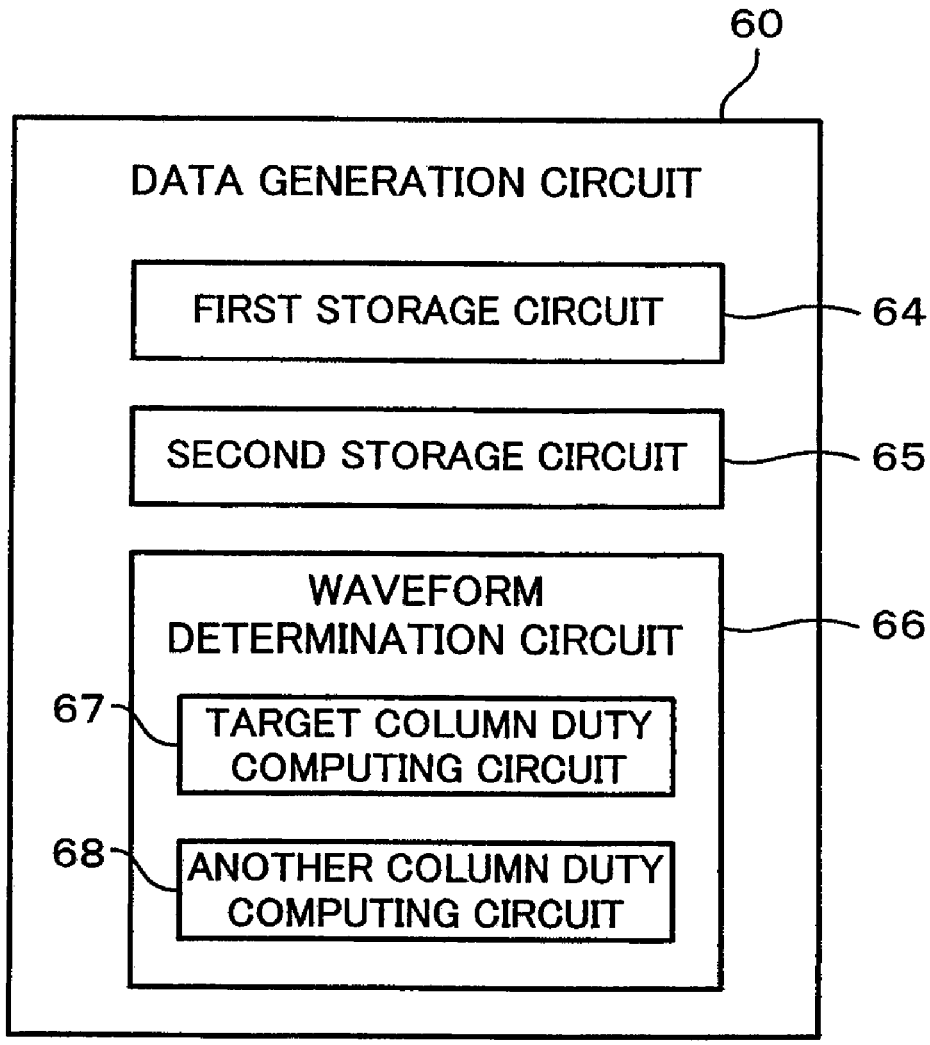
FIG. 7 is a block diagram illustrating a data generating circuit.

FIG. 7 is a block diagram of the data generation circuit 60. The data generation circuit 60 includes a first storage circuit 64 (first storage unit), a second storage circuit 65 (second storage unit), and a waveform determination circuit 66 (droplet type determination unit). The following describes the circuits 64 to 66 in sequence.

The first storage circuit 64 stores in the PC 59 information on the four types of droplets set for each of the nozzles 30. Here, the information on the four types of droplets is for distinguishing between a type of droplet and another type of droplet, such as the names of droplets: no ejection, droplet S, droplet M, and droplet L. FIG. 8 illustrates the four types of droplets stored in the first storage circuit 64. Further, a droplet volume (unit: p1) is set for each of the four types of droplets.

The second storage circuit 65 stores time-sequence information of an ejection mode transmitted from the PC 59. The time-sequence information is for associating an ejection timing of each of the nozzles 30 with one of the four types of droplets: no ejection, droplet S, droplet M, and droplet L.

The inkjet head 3 of the present embodiment ejects droplets through the nozzles 30 towards a recording sheet P while moving in the scanning direction at constant speed. At this time, each of the nozzles 30 has an ejection timing at constant time intervals. Here, an ejection timing is timing when the nozzle 30 can eject a droplet, but whether or not the nozzle actually ejects a droplet at the ejection timing depends on an image to be recorded. For example, each of the nozzles 30 ejects a droplet at every ejection timing when performing a fill printing where dots are formed on the entire surface of the recording sheet P. On the other hand, when fewer dots are to be formed such as when performing a text printing, each of the nozzles 30 ejects a droplet less frequently even when ejection timings come.

FIG. 9 illustrates time-sequence information of a type of droplet to be ejected through a nozzle 30. In the time-sequence information, a plurality of ejection timings of a nozzle 30 such as tm1, tm2, tm(n−1), tm(n), tm(n+1) are arranged in time sequence, and a type of droplet to be ejected is associated with each of the ejection timing tm, as illustrated in FIG. 9. In the example illustrated in FIG. 9, a droplet M is to be ejected at a timing tm(n). Further, a droplet S is to be ejected at an ejection timing tm (n−1), which is one ejection timing before the ejection timing tm(n). A droplet L is to be ejected at an ejection timing tm (n+1), which is one ejection timing after the ejection timing tm(n).

The waveform determination circuit 66 determines a drive waveform corresponding to a type of droplet associated with an arbitrary ejection timing of each of the nozzles 30, with reference to the ejection plan of the nozzle 30, and the type of a droplet which is associated with another nozzle 30 at the arbitrary ejection timing included in the time-sequence information stored in the second storage circuit 65.

Here, in order to consider crosstalk among nozzles 30 which simultaneously eject droplets, a type of droplet to be associated with an arbitrary ejection timing of each of the nozzles 30 of the inkjet head 3 may be determined with reference to a type of droplet ejected through another nozzle 30. In this case, however, it takes a lot of time to process when there are many nozzles 30. The present invention thus considers crosstalk not between each individual nozzle, but between nozzle columns each of which is a group of nozzles 30. In other words, a drive waveform is determined for each of the nozzles 30 with consideration of crosstalk influencing a droplet, which crosstalk is produced between the nozzle column to which the nozzle 30 belongs and adjacent another nozzle column.

The following more specifically describes a method for determining a drive waveform. Crosstalk is considered for each nozzle column in the following determination of a drive waveform. Note that a nozzle column in this case is a groups of nozzles 30 communicating with one manifold 27 (common liquid chamber); e.g., nozzle column 32A or 32B in FIG. 2. In this case, a drive waveform is determined for each ejection timing of each of the nozzles 30 with consideration of crosstalk between the adjacent nozzle columns 32A and 32B respectively corresponding to the two manifolds 27.

(1) Calculation of Target Column Duty and Another Column Duty First, a parameter called duty is adapted in order to indicate a level of crosstalk produced between one nozzle column and an adjacent another nozzle column, the duty being associated with the number of nozzles which simultaneously eject droplets among nozzles of each of the nozzle columns. The one nozzle column is where a nozzle 30 belongs to for which nozzle 30 a drive waveform is determined. The one nozzle column is hereinafter referred to as target nozzle column or simply as target column. The another nozzle column is hereinafter also simply referred to as another column. Nozzles which simultaneously eject droplets at certain timing are hereinafter referred to as simultaneously-ejecting nozzles.

In other words, the more simultaneously-ejecting nozzles 30 there are among nozzles 30 forming a nozzle column, the higher the level of duty. By the same token, the fewer simultaneously-ejecting nozzles 30 there are among nozzles 30 forming a nozzle column, the lower the level of duty. That is, a duty is a level of ink volume ejected from each nozzle column. In other words, a duty indicates a level of energy applied to a nozzle column by the actuator unit 7. The higher a duty of a nozzle column, the higher the energy; i.e., pressure wave, mechanical vibration or the like dispersed to adjacent another column. This increases the crosstalk influencing the another column.

As illustrated in FIG. 7, the waveform determination circuit 66 includes a target column duty computing circuit 67 (target column duty obtain unit) and an another column duty computing circuit 68 (another column duty obtain unit). The target column duty computing circuit 67 calculates, for each of the nozzles 30, a target column duty of the target nozzle column to which the nozzle 30 belongs. The another column duty computing circuit 68 calculates, for each of the nozzles 30, an another column duty of the another nozzle column adjacent to the target column.

The following method may be employed for calculating a duty by the target column duty computing circuit 67 and the another column duty computing circuit 68, for example. First, the waveform determination circuit 66 obtains the number of simultaneously-ejecting nozzles 30 among nozzles 30 forming a nozzle column, with reference to the time-sequence information stored in the second storage circuit 65. In other words, with reference to the time-sequence information, the waveform determination circuit 66 obtains the number of nozzles 30 which are associated with any of the droplets S, M, and L. Then, the ratio of the number of simultaneously-ejecting nozzles to the total number of nozzles 30 forming the nozzle column is set as a duty. That is, when the total number of nozzles in the nozzle column is n0, and the number of simultaneously-ejecting nozzles is n1, a duty D (%) is calculated using the equation $(n1/n0)\times 100$. In this case, when all the nozzles 30 of the nozzle column are to eject droplets, the duty is 100%. Reversely, when none of the nozzles 30 of the nozzle column is to eject a droplet, the duty is 0%.

(2) Determining Drive Waveform Next, a drive waveform to be associated with the ejection timing tm(n) of each of the nozzles 30 is determined based on the ejection plan of the nozzle 30 included in the time-sequence information, and the target column duty and the another column duty calculated in the above (1).

Before describing determination of a drive waveform, the following describes a basic method of selecting a drive waveform only by using the ejection plan, disregarding the target column duty or the another column duty; i.e., influence of crosstalk. FIG. 10 illustrates a table used for such a drive waveform selection process. In FIG. 10, a drive waveform associated with an ejection timing tm(n) in the time-sequence information is susceptible to droplet types associated with the preceding ejection timing tm(n−1) and the following ejection timing tm(n+1) in the following two aspects.

First, when a droplet S is ejected at an ejection timing, a volume of the droplet actually ejected more likely differs from a predetermined droplet volume than when a droplet M or a droplet L is ejected at the ejection timing, due to a pressure wave; i.e., variation in ink pressure, mechanical vibration of the actuator unit 7, or the like left from the preceding ejection. Particularly, when a droplet L has been ejected at the preceding ejection timing, a magnitude of a residual pressure wave or the like is high. This causes the difference between the actual droplet volume and the predetermined droplet volume to be even larger. Thus, as illustrated in FIG. 10, when a droplet S is to be ejected at the ejection timing tm(n), and a droplet L is ejected at the preceding ejection timing tm(n−1), the type of droplet to be ejected at the ejection timing tm(n) is changed to a droplet M to be less susceptible to a pressure wave left from the preceding ejection.

Further, as briefly referenced above, a satellite droplet may be ejected after a droplet L is ejected due to a residual pressure wave. This is critical especially when ejection of a droplet L is followed by no droplet ejection. Therefore, as illustrated in FIG. 10, when a droplet L is to be ejected at the ejection timing tm(n) followed by a droplet ejection at the ejection timing tm(n+1), that is, when one of droplets S, M, and L is to be ejected at the ejection timing tm(n+1), the drive waveform L1 is selectively associated with the ejection timing tm(n). Meanwhile, when no droplet is to be ejected at the ejection timing tm(n+1), that is, when the type of droplet associated with the ejection timing tm(n+1) is no ejection, the drive waveform L2; i.e., long waveform capable of preventing a satellite droplet is selectively associated with the ejection timing tm(n).

Note that the above mentioned selection between the drive waveforms L1 and L2 with reference to the ejection timing tm(n+1) is not changing the type of droplet itself from a droplet L to another type of droplet. That is, in the present embodiment, only the types of droplets associated with the ejection timing tm(n) and the ejection timing tm(n−1) are referred to as the ejection plan to determine the type of the droplet to be associated with the ejection timing tm(n), disregarding the type of droplet associated with the ejection timing tm(n+1). This is because the present embodiment places an emphasis particularly on a variation in the droplet volume ejected at an ejection timing, which variation caused by ejection of a droplet at the preceding ejection timing, such as a pressure wave and mechanical vibration left from the preceding ejection. Further, one of the reasons why the type of droplet associated with the following ejection timing is not referred to is that the influence of the droplet ejection at the ejection timing tm(n) on the ejection timing tm(n+1) is considered when determining the type of droplet to be associated with the ejection timing tm(n+1). Thus, it is not highly necessary to refer to the types of droplets associated with both the preceding and following ejection timings.

Based on the above mentioned drive waveform determination method referring to the ejection plan, the waveform determination circuit 66 determines a drive waveform with further reference to the target column duty and the another column duty. The waveform determination circuit 66 has tables as shown in FIGS. 11 and 12, each of which tables associates the ejection plan, the target column duty, and the another column duty of each of the nozzles 30.

The present embodiment considers the crosstalk produced by droplet ejection of the target column influencing the another column by comparing the target column duty with a first threshold value, as illustrated in FIGS. 11 and 12. In this case, the first threshold value is 50%. FIGS. 11(*a*) and (*b*) illustrate cases where the target column duty is 50% or more, and FIGS. 12(*a*) and (*b*) illustrate cases where the target column duty is less than 50%. Further, the present embodiment considers crosstalk produced by the droplet ejection of the another column influencing the target column, by classifying droplet ejection by comparing the another column duty with a second threshold value, as illustrated in FIGS. 11(*a*) and 12(*b*) In this case, the second threshold value is 50%. FIGS. 11(*a*) and 12(*a*) illustrate cases where the another column duty is 50% or more, and FIGS. 11(*b*) and 12(*b*) illustrate cases where the another column duty is less than 50%.

The type of droplet associated with the nozzles 30 of the target column is preferably set to be smaller when a target column duty is high; i.e., 50% or more in order to reduce crosstalk produced by the target column influencing the nozzles 30 of the another column. Thus, as illustrated in FIGS. 11(*a*) and (*b*), especially when a droplet L is to be ejected at the ejection timing tm(n) based on time-sequence information (see lower rows of the tables), the type of droplet is changed to a droplet M having a smaller volume, and a drive waveform corresponding to the droplet M (see FIG. 5) is selected. Meanwhile, when the target column duty is low; i.e., less than 50%, consideration of crosstalk influencing the another column is less necessary. Therefore, as illustrated in FIGS. 12(*a*) and (*b*), the type of droplet of the ejection timing tm(n) is not changed even when a droplet L is to be ejected at the ejection timing tm(n) based on the time-sequence information. In this case, a drive waveform corresponding to the droplet L is selected between the drive waveforms L1 and L2 illustrated in FIG. 5.

When the another column duty is high; i.e., 50% or more, crosstalk produced by the another column greatly influences the nozzles 30 of the target column. Therefore, droplet types associated with the nozzles 30 of the target column is preferably set to be larger to prevent the droplet volume from undergoing a variation caused by the crosstalk. Thus, particularly when a droplet S is associated with the ejection timing tm(n) according to the time-sequence information (see upper rows of the tables) as illustrated in FIGS. 11(*a*) and 12(*a*), the type of droplet is changed to a droplet M having a larger volume, and a drive waveform corresponding to the droplet M (see FIG. 5) is selected. Meanwhile when the another column duty is low; i.e., less than 50%, consideration of crosstalk produced by the another column is less necessary. Thus, the type of droplet remains the same even when a droplet S is associated with the ejection timing tm(n) according to the time-sequence information, as illustrated in FIGS. 11(*b*) and 12(*b*).

As a result in the cases illustrated in FIG. 11(*a*) where both the target column duty and the another column duty are high, each of the types of droplets to be ejected through the nozzles 30 of the target column is set to be a droplet M, which is less likely to produce crosstalk influencing the another column, and whose droplet volume is less likely to undergo a variation caused by crosstalk produced by the another column. Meanwhile in the cases illustrated in FIG. 12(*b*) where both the target column duty and the another column duty are low, consideration of crosstalk is less necessary. Thus, the type of droplet remains the same as the droplet set according to the time-sequence information.

In other words, in the cases illustrated in FIG. 12(*b*) where little crosstalk is produced thus an influence of the crosstalk is disregarded, the waveform is determined with the same method as illustrated in FIG. 10 where the target column duty and the another column duty are disregarded. When determining a drive waveform to be associated with a nozzle according to the ejection plan, traditional printers disregarded crosstalk produced by another nozzle; however, the traditional printers were designed with recognition of a worst case situation where crosstalk produced by the another nozzle is extremely high. In such a worst case situation and in a case where a type of droplet is likely to undergo a significant variation, a type of droplet is changed from a droplet S to a droplet M in the cases illustrated in FIG. 10.

Meanwhile, FIG. 12(*b*) of the present embodiment illustrates cases presuming that an influence of crosstalk is little as a result of consideration of the target column duty and the another column duty. Thus, it is absolutely unnecessary in this case to consider a situation where crosstalk is high. In a situation where an influence of crosstalk from the vicinity barely exists but only an influence of the preceding ejection exists, it is considered that a droplet volume does not undergo a significant variation. Therefore, a type of droplet is not changed from a droplet S to a droplet M even when a droplet L is ejected at the preceding ejection timing in the cases illustrated in FIG. 12(*b*), but a type of droplet of each of the cases is the same as the type of droplet determined according to the time-sequence information obtained through the image process of the PC 59, as illustrated in FIG. 10. In other words in the present embodiment, a type of droplet is changed from a type of droplet determined according to the time-sequence information when both the crosstalk between the nozzle and the vicinity of the nozzle and a type of droplet ejected at the preceding ejection timing are influential. However, the type of droplet remains the same as the type of droplet determined according to the time-sequence information when barely any crosstalk exists. Thus, the type of droplet associated with the present ejection timing does not excessively accommodate to the preceding droplet ejection, which is preferable in reproduction of an image.

As described above, the inkjet printer of the present embodiment determines a type of droplet ejected at an arbitrary ejection timing of each of the nozzles 30 with reference to not only the ejection plan of the nozzle 30, but the type of droplet simultaneously ejected through another nozzle 30. That is, the inkjet printer is capable of determining a type of droplet ejected through each of the nozzles 30 with consideration of crosstalk produced between the nozzle 30 and another nozzle 30.

Further, the present embodiment considers crosstalk between simultaneously-ejecting nozzles 30 not for each nozzle 30, but for each nozzle column which is a group of nozzles 30. That is, the present embodiment obtains a parameter; i.e., duty indicating a level of droplet ejection of each nozzle column, the duty being associated with the number of simultaneously-ejecting nozzles of the nozzle column. A duty is obtained for each of a target nozzle column and another nozzle column, the target nozzle column being where a nozzle 30 belongs for which nozzle 30 a type of droplet to be associated with is determined. The duties obtained for each nozzle column is employed when determining a type of droplet to be ejected, in order to consider crosstalk produced between the nozzle columns influencing a droplet to be ejected through each nozzle 30. Thus, crosstalk is considered for each nozzle column. This enables relatively easy determination of a type of droplet to be associated with a nozzle 30 compared to when crosstalk is considered between a nozzle 30 and another nozzle 30 for each of the nozzles 30.

Further in the present embodiment, the target column duty computing circuit 67 and the another column duty computing circuit 68 respectively calculate the target column duty and the another column duty from the number of simultaneously-ejecting nozzles obtained from the time-sequence information. Meanwhile, a type of droplet to be ejected is determined based on the calculated target column duty and the another column duty with reference to the tables illustrated in FIGS. 11 and 12, which table associates the ejection plan of each of the nozzles 30, the target column duty, and the another column duty which are predetermined. Accordingly, a type of droplet to be associated with each of the nozzles 30 is relatively easily determined.

Next, the following describes a modified embodiment where a various modifications are added to the above embodiment. Note that the members having the same structures as those in the above embodiment will be denoted by the same reference numerals, without specific descriptions thereof.

1] The above embodiment determines the target column duty and the another column duty only by the number of simultaneously-ejecting nozzles of each nozzle column, the number being obtained from time-sequence information. However, in addition to the number of simultaneously-ejecting nozzles, the duties may be calculated based on a droplet volume; i.e., droplets S, droplet M, or droplet L ejected by each of the simultaneously-ejecting nozzles.

For example, a duty may be calculated by weighing each of the nozzles 30 according to a volume of a droplet to be ejected through the nozzle 30. For instance, among the simultaneously-ejecting nozzles 30 of a nozzle column, the number of nozzles 30 each associated with a droplet S according to time-sequence information is ns, the number of nozzles 30 each associated with a droplet M is nm, and the number of nozzles 30 each associated with a droplet L is n1. In this case, a duty D (%) may be calculated using the equation $\{0.15\times ns+0.5\times nm+1\times n1)/n0\}\times 100$. Here, 0.15, 0.5, and 1 respectively multiplied by ns, nm, and n1 are weighing factors each corresponding to a droplet volume.

Thus, the target column duty and the another column duty are calculated with consideration of not only the number of simultaneously-ejecting nozzles of each nozzle column, but volumes of droplets to be ejected through the nozzles 30. Thus, a type of droplet to be associated with each of the nozzles 30 is determined with more proper consideration of crosstalk produced between the target column and the another column.

2] A nozzle column which is a subject for consideration of crosstalk, is defined as a group of nozzles 30 communicating with one manifold in the above embodiment. The original idea, however, is that it is more efficient to consider crosstalk for a group of nozzles 30 than for each of the nozzles 30. Thus, the definition of a nozzle column is not particularly limited to the one in the above embodiment. For instance, a nozzle column may be defined as a plurality of nozzles aligned in such a manner that a distance between nozzles of the nozzle column is smaller than a distance between a nozzle of the nozzle column and a nozzle of adjacent nozzle column. That is, a nozzle column is an alignment of a group of nozzles 30 whose distance between each nozzle 30 is the shortest, among the nozzles 30 arranged on the lower surface of the inkjet head 3. In this case, a type of droplet to be ejected through each of the nozzles 30 is determined with consideration of crosstalk between two nozzle columns adjacent to one another with a distance therebetween, the distance being larger than the distance between nozzles forming a nozzle column.

3] The target column duty and the another column duty is respectively classified by a threshold value 50% for consideration of crosstalk in the above embodiment (see FIGS. 11 and 12). However, there may be a plurality of threshold values for more complex classification.

For example, the target column duty and the another column duty may be respectively classified by three threshold values 80%, 50%, and 20% as illustrated in FIGS. 13 to 16. The basic idea in this case is the same as that of the above embodiment. That is, a type of droplet to be ejected at the ejection timing tm(n) is changed from a droplet L to a droplet M when the target column duty is high, in order to reduce crosstalk influencing the another target column. Further, the type of droplet to be ejected at the ejection timing tm(n) is changed from a droplet S to a droplet M when the another column duty is high, in order to make the target column be less susceptible to the crosstalk produced by the another column.

4] In the above embodiment, a type of droplet of an ejection timing tm(n) is determined only with reference to, as the ejection plan, a type of droplet associated with the ejection timing tm(n) according to the time-sequence information and a type of droplet associated with the preceding ejection timing tm(n−1). The above embodiment utilizes a type of droplet to be ejected at the following ejection timing tm(n+1) when making a selection between the drive waveforms L1 and L2; however, the type of droplet to be ejected at the ejection timing tm(n+1) is not referred to when determining a type of droplet to be ejected at the ejection timing tm(n). However, the type of droplet associated with the ejection timing tm(n+1) may be referred to in order to determine a type of droplet to be associated with the ejection timing tm(n).

For example, when a droplet L is to be ejected at the ejection timing tm(n), the ejection leaves a large pressure wave in the ejection timing tm(n+1), which influences the droplet volume to likely undergo a variation when a droplet S is to be ejected at the ejection timing tm(n+1). Therefore, the type of droplet associated with the ejection timing tm(n) can be changed from a droplet L to a droplet M when a droplet S is associated with the ejection timing tm(n+1).

Further, both of the types of droplets respectively associated with the ejection timings tm(n−1) and tm(n+1) may be referred to in order to determine the type of droplet to be associated with the ejection timing tm(n).

5] The above embodiment considers crosstalk for each nozzle column by adapting a parameter called a duty when determining a type of droplet to be associated with each of the nozzles 30. However, crosstalk is not necessarily considered for each nozzle column. Indeed, crosstalk may be considered for each nozzle 30. That is, a type of droplet to be associated with an arbitrary ejection timing of each of the nozzles 30 may be determined with reference to a type of droplet associated with another nozzle 30. Alternatively, a type of droplet to be associated with each of the nozzles 30 may be determined with reference to a type of droplet associated with another nozzle 30 adjacent to the nozzle 30 both belonging to the same nozzle column, as well as with consideration of crosstalk between nozzle columns as the above embodiment.

6] Determination of a type of droplet to be associated with an arbitrary ejection timing of each of the nozzles 30 with reference to the ejection plan of the nozzle 30 included in the time-sequence information and a type of droplet of another nozzle 30 is realized by hardware ASIC 54 in the above embodiment. However, software may realize this. That is, a droplet ejection control program may be run in the CPU thus allowing the microcomputer to fulfill the function same as the data generation circuit 60, the droplet ejection control program being stored in the ROM of the microcomputer; i.e., computer-readable storage medium.

In other words, the droplet ejection control program is run in the CPU to cause the microcomputer to function as (1) the first storage unit, (2) the second storage unit, and (3) the droplet type determination unit. The first storage unit stores therein information on a plurality of types of droplets. The second storage unit stores therein time-sequence information of types of droplets, which time-sequence information associates a type of droplet with each ejection timing of each of the nozzles 30. The droplet type determination unit determines a type of droplet to be associated with an arbitrary ejection timing of each of the nozzles 30, with reference to the ejection plan of the nozzle 30, and the type of droplet associated with the arbitrary ejection timing of another nozzle 30.

7] In the above embodiment, image processing is performed on image data in the PC 59 serving as an external device, and time-sequence information is generated in the PC 59 and transmitted to the ASIC 54 of the printer, the time-sequence information associating each ejection timing with one of the four types of droplets. However, the printer may be configured to generate the time-sequence information. For instance, the printer needs to generate the time-sequence information when an image storage medium storing image data therein is directly connected to the printer without an external device such as a PC therebetween, and thus the printer records on a recording sheet P the image stored in the image storage medium.

Alternatively, the external device may perform the both processes of: generation of the time-sequence information associating a type of droplet with an ejection timing of each of the nozzles 30; and determination of type of droplet with reference to the ejection plan of the nozzle 30 and the type of droplet associated with another nozzle 30.

The embodiment and the modified embodiment described above adapt the present invention for an inkjet printer which ejects ink on a recording sheet and thus records an image or the like. The present invention, however, is not limited to such usage. In other words, the present invention is adaptable for various types of liquid droplet ejection apparatuses which eject various types of liquid other than ink towards a target according to a purpose.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid droplet ejecting apparatus capable of selectively ejecting, through each of a plurality of nozzles, a type of droplet among a plurality of types of droplets each having a different droplet volume, comprising:

a first storage unit storing therein information on the plurality of types of droplets;

a second storage unit which stores therein time-sequence information of a type of droplet, where the time-sequence information associates each ejection timing of each of the nozzles with one of the types of droplets stored in the first storage unit; and a droplet type determination unit which determines a type of droplet to be associated with an arbitrary ejection timing of each of the nozzles, with reference to an ejection plan of the nozzle and a type of droplet associated with the arbitrary ejection timing of another nozzle, the ejection plan including types of droplets associated with the arbitrary ejection timing and at least one of the preceding and following ejection timings according to the time-sequence information.

2. The liquid droplet ejecting apparatus according to claim 1;

wherein the droplet type determination unit refers to, as an ejection plan of each of the nozzles, types of droplets respectively associated with the arbitrary ejection timing and the preceding ejection timing according to the time-sequence information.

3. The liquid droplet ejecting apparatus according to claim 1;

wherein the nozzles are aligned in a predetermined direction to form a plurality of nozzle columns;

wherein the liquid droplet ejecting apparatus further comprises:

a target column duty obtaining unit which obtains, at an arbitrary ejection timing of each of the nozzles based on the time-sequence information stored in the second storage unit, a parameter referred to as a duty associated with the number of simultaneously-ejecting nozzles of one of the nozzle columns, which one nozzle column the nozzle belongs to; and an another column duty obtaining unit which obtains at an arbitrary ejection timing of each of the nozzles based on the time-sequence information stored in the second storage unit, a duty of a nozzle column other than the one nozzle column; and wherein the droplet type determination unit determines a type of droplet to be ejected at an arbitrary ejection timing of each of the nozzles based on the ejection plan of the nozzle, a target column duty obtained by the target column duty obtaining unit, and an another column duty obtained by the another column duty obtaining unit.

4. The liquid droplet ejecting apparatus according to claim 3, further comprising:

a plurality of common liquid chambers respectively corresponding to the nozzle columns;

wherein a plurality of nozzles belonging to one of the nozzle columns communicate with one of the common liquid chambers corresponding to the one nozzle column.

5. The liquid droplet ejecting apparatus according to claim 3;

wherein a distance in an array direction between nozzles of one of the nozzle columns is shorter than a distance between a nozzle of the one nozzle column and a nozzle of an adjacent nozzle column.

6. The liquid droplet ejection apparatus according to claim 3;

wherein the information stored in the first storage unit includes at least three types of droplets including a large droplet, a medium droplet, and a small droplet; and wherein the droplet type determination unit changes a type of droplet from a large droplet to a medium droplet when a large droplet is associated with the arbitrary ejection timing according to the time-sequence information and the target column duty is equal to or higher than a predetermined first threshold value.

7. The liquid droplet ejecting apparatus according to claim 3;

wherein the information stored in the first storage unit includes at least three types of droplets including large droplet, medium droplet, and small droplet; and wherein the droplet type determination unit changes a type of droplet from a small droplet to a medium droplet when a small droplet is associated with the arbitrary ejection timing according to the time-sequence information and the another column duty is equal to or higher than a predetermined second threshold value.

8. The liquid droplet ejecting apparatus according to claim 3;

wherein the target column duty obtaining unit and the another column duty obtaining unit respectively calculate the target column duty and the another column duty based on the number of simultaneously-ejecting nozzles obtained by the time-sequence information;

wherein the droplet type determination unit includes a table which associates the ejection plan, the target column duty, and the another column duty; and wherein the droplet type determination unit determines a type of droplet to be associated with an arbitrary ejection timing of each of the nozzles with reference to the table, based on the ejection plan of the nozzle, the target column duty calculated by the target column duty obtaining unit, and the another target duty calculated by the another column duty obtaining unit.

9. The liquid droplet ejecting apparatus according to claim 8;

wherein the target column duty obtaining unit and the another column duty obtaining unit respectively calculate the target column duty and the another column duty based on:

the number of simultaneously-ejecting nozzles obtained from the time-sequence information; and a volume of a droplet ejected through each of the simultaneously-ejecting nozzles.

10. A computer program product stored in a non-transitory computer-readable medium, the computer program product causing a computer, which controls a droplet ejecting apparatus which selectively ejects through each of a plurality of nozzles one of a plurality of types of droplets each having a different droplet volume, to function as:

a first storage unit which stores therein information on the plurality of types of droplets;

a second storage unit which stores therein time-sequence information of a type of a droplet which associates each ejection timing with one of the plurality of types of droplets stored in the first storage unit; and a droplet type determination unit which determines a type of droplet to be associated with an arbitrary ejection timing of each of the nozzles, with reference to an ejection plan of the nozzle and a type of droplet associated with the arbitrary ejection timing of another nozzle, the ejection plan including types of droplets associated with the arbitrary ejection timing and at least one of the preceding and following ejection timings according to the time-sequence information.

* * * * *